US006484705B2

(12) United States Patent
Bircann et al.

(10) Patent No.: US 6,484,705 B2
(45) Date of Patent: Nov. 26, 2002

(54) PINTLE VALVE HAVING AN INTERNAL FLOW MODIFIER WITH SELF-ALIGNING HEAD

(75) Inventors: Raul A. Bircann, Penfield, NY (US); Dwight O. Palmer, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 17 days.

(21) Appl. No.: 09/790,267

(22) Filed: Feb. 21, 2001

(65) Prior Publication Data

US 2002/0112707 A1 Aug. 22, 2002

(51) Int. Cl.[7] ..... F02M 25/07
(52) U.S. Cl. ..... 123/568.18; 123/568.11
(58) Field of Search ..... 123/568.18, 568.11

(56) References Cited

U.S. PATENT DOCUMENTS 3,820,514 A * 6/1974 Kuehl ..... 123/568.18
4,341,351 A * 7/1982 Deluca ..... 239/453
4,351,285 A * 9/1982 Bradshaw ..... 123/568.29
4,387,693 A * 6/1983 Romblom ..... 123/568.3
5,163,295 A * 11/1992 Bradshaw ..... 123/568.19
5,609,143 A * 3/1997 Schellenberg ..... 123/568.18

* cited by examiner

*Primary Examiner*—Paul J. Hirsch
(74) *Attorney, Agent, or Firm*—Patrick M. Griffin

(57) ABSTRACT

A flow modifier for insertion into the chamber of a large pintle valve to change the apparent flow range of the valve to that of a smaller valve. The flow modifier includes a perforated cup-shaped restrictor disposed within the valve on the valve pintle and sealingly surrounding the valve seat such that all flow through the valve must pass through the passageways in the restrictor. The restrictor is held in place by a compression spring surrounding the pintle. The total open area of the passageways may be varied by varying their number and/or size and is preferably substantially less than the open area of the valve seat. The restrictor thus acts as a flow choke or fixed throttle to reduce the flow range of the valve. Different restrictors may be provided as required to size a single large valve having a large inherent flow range to a plurality of applications requiring valves having smaller flow ranges. A further embodiment includes a valve head resiliently and articulably mounted on the internal end of the valve pintle. The head is free to move axially and/or radially and/or rotationally with respect to the pintle as directed by the mating surface of the valve seat to effect a seal therewith.

6 Claims, 4 Drawing Sheets

PINTLE VALVE HAVING AN INTERNAL FLOW MODIFIER WITH SELF-ALIGNING HEAD

TECHNICAL FIELD

The present invention relates to pintle-type valves; more particularly, to such valves for variably regulating the flow of fluids and especially gases; and most particularly, to an exhaust gas recirculation (EGR) pintle valve for permitting the controlled admission of exhaust gas into the fuel intake manifold of an internal combustion engine, wherein the valve is provided with an internal flow modifier to change the inherent flow control range of the valve and a head resiliently mounted on a pintle so that the head is self-aligning in a valve seat.

BACKGROUND OF THE INVENTION

It is well known in the automotive art to provide a variable valve connecting the exhaust manifold with the intake manifold of an internal combustion engine to permit selective and controlled recirculation of a portion of an engine's exhaust gas into the fuel intake stream. Such recirculation is beneficial for reducing the bum temperature of the fuel mix in the engine to reduce formation of nitrogen and sulfur oxides which are significant components of smog. Such a valve is known in the art as an exhaust gas recirculation (EGR) valve.

A typical prior art EGRpintle-type valve has a valve body enclosing a chamber; a valve seat dividing the chamber between first and second ports; a valve pintle, or stem, extending from the valve head through a bore in a sidewall of the valve body; a valve head fitted to mate with the valve seat and being rigidly attached to and coaxial with the pintle; and a solenoid actuator mounted on the exterior of the valve body and operationally connected to the outer end of the valve pintle, whereby the valve head is axially reciprocated to open and close the valve. The axial stroke of the solenoid may be regulated as by a computer to vary the axial position of the valve pintle and valve head with respect to the valve seat to provide a desired flow volume of fluid through the valve.

Any pintle-type valve has an inherent flow range over which the flow of fluid may be controlled by varying the position of the valve head, from fully closed to wide open. Valves of various size may all have the same relative sensitivity to percent flow variation as a function of pintle motion. However, the sensitivity of control in terms of absolute flow is a function of the size of the valve. Thus, for a wide range of engine sizes, a wide range of EGR valve sizes is presently required. Large engines require large EGR valves, and smaller engines require smaller EGR valves. A large EGR valve on a small engine cannot be controlled with the degree of flow resolution required. If an EGR valve is too small for an engine, then fuel economy and emissions quality can be compromised; if sized too large, then controllability, durability, and performance can be compromised.

Further, the completeness or quality of sealing demonstrated by a known pintle valve depends upon the degree of geometric perfection achieved in the manufacture and assembly of the various components. In many applications, the seat and head are formed of hard metals, which are non-resilient and non-compliant. Therefore, a first requirement is that the seat and head each be perfectly circular so that they can meet to form a seal in an unbroken circular contact line. Fortunately, it is relatively straightforward in the known art to provide a circular seat and head.

A second requirement is that the seat and head be presented to each other in coaxial alignment. This is a much more difficult requirement to meet because the bore in the valve body for the pintle must be not only coaxial with the bore for the seat but must also be absolutely orthogonal to a plane containing the seat. Otherwise, a torque is exerted by the head on the pintle as the head attempts to align itself with the seat. With minimal misalignment, the head may be seated but repeated actuation of the valve may cause rapid wear on the misaligned components and the valve may fail prematurely. With greater misalignment, the valve may simply fail to close.

An added complication in providing a perfectly-sealing valve is that the use conditions of a valve may differ dramatically from the conditions of manufacture and calibration. For example, an EGR valve may be asked to operate flawlessly at 350° C. or greater, and at a starting temperature below 0° C., from fully open to fully closed. The potential for thermal distortion of various components over this range of temperatures requires careful selection of materials and extremely high-quality machining of components. Thus, the manufacture of such valves can be very costly and time-consuming.

An added source of wear in prior art pintle-type valves is the repeated shock of closing the non-resilient head at full solenoid actuation velocity abruptly against the non-resilient seat. Typically, the seat is formed of extremely hard material, for example, Stellite, the wear being taken by the head.

What is needed is a simple means for allowing a large valve to behave like a smaller valve, so that a single valve can be used over a wide range of engine sizes, thus reducing manufacturing and replacement part complexity and cost. What is further needed is a pintle-type valve wherein the valve head is axially and radially and rotationally movable with respect to the pintle to allow the head to be self-aligning in these dimensions with the seat.

It is the object of the invention to provide a simple, inexpensive means for adapting a single valve configuration to have a plurality of flow ranges, while improving flow resolution.

It is a further object of the invention to save cost and complexity in manufacturing and inventorying EGR valves for internal combustion engines.

It is yet a further object of the invention to provide an improved pintle-type valve wherein the geometric manufacturing requirements and tolerances of the valve body, seat, pintle, and head may be relaxed without compromising the performance characteristics of the valve.

It is a further object of the invention to provide an improved high-performance pintle-type valve which is inexpensive to manufacture.

SUMMARY OF THE INVENTION

The present invention is directed to a flow modifier for insertion into the chamber of a large pintle valve to change the apparent flow range of the valve to that of a smaller valve. The flow modifier includes a perforated cup-shaped restrictor disposed within the valve on the valve pintle and sealingly surrounding the valve seat such that all flow through the valve must pass through the passageways in the restrictor. The restrictor is held in place by a compression spring surrounding the pintle. The total open area of the passageways may be varied by varying their number and/or size and is preferably substantially less than the open area of the valve seat. The restrictor thus acts as a flow choke or fixed throttle to reduce the flow range of the valve. The restrictor is simple and inexpensive to fabricate, and different restrictors may be provided as required to size a single large valve having a large inherent flow range to a plurality of applications requiring valves having smaller flow ranges. The invention is especially suited to exhaust gas recirculation valve requirements over a wide range of displacement of internal combustion engines.

A further embodiment of the invention is directed to a pintle-type valve having a valve head resiliently mounted on the internal end of the valve pintle. The head is thus free to move axially and/or radially and/or rotationally with respect to the pintle and seat as directed by the mating surface of the valve seat to effect a seal. The head includes a chamber for receiving the end of the pintle and an inwardly-rolled skirt on the well for articulatably capturing the head onto the pintle. Spring means, such as a coil or leaf spring, is disposed between the head and the pintle in the chamber to keep the head generally aligned with the pintle whilst allowing excursions of the head to mate the head sealably with the valve seat and to absorb the shock of such mating.

BRIEF DESCRIPTION OF THE DRAWINGS

The foregoing and other objects, features, and advantages of the invention, as well as presently preferred embodiments thereof, will become more apparent from a reading of the following description in connection with the accompanying drawings, in which.

DESCRIPTION OF THE PREFERRED EMBODIMENT

The benefits afforded by the present invention will become more readily apparent by first considering a prior art valve.

Figure 1:
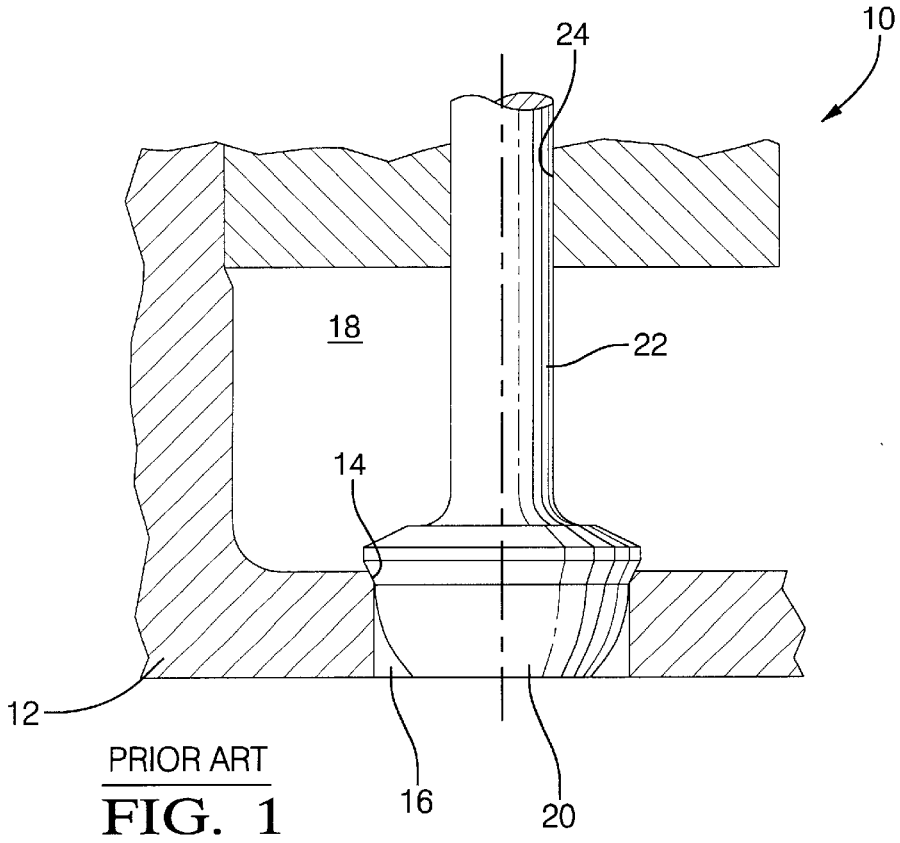
PRIOR ART FIG. 1
FIG. 1 is an elevational cross-sectional view of a prior art pintle valve in closed position.
Figure 2:
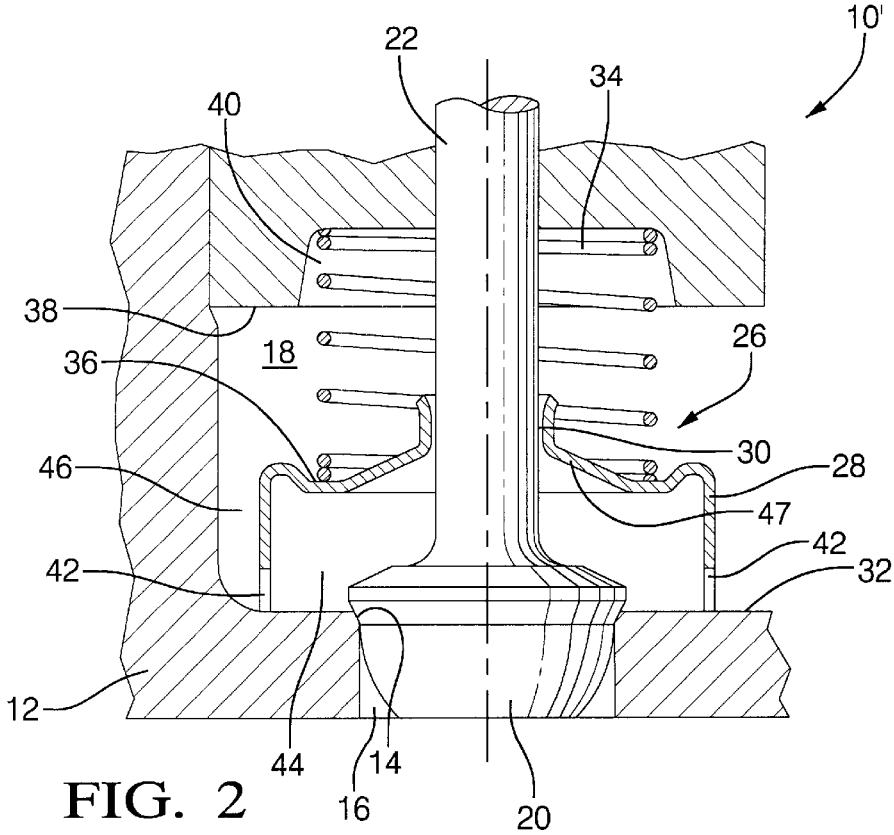
FIG. 2 is an elevational cross-sectional view of an embodiment of a pintle valve in accordance with the invention, showing a flow modifier comprising a flow restrictor and a spring disposed within the valve.

Referring to FIG. 1, a prior art pintle valve 10 includes a valve body 12 having a valve seat 14 separating a first chamber 16 from a second chamber 18. In use as, for example, an EGR valve, chambers 16 and 18 may communicate with the exhaust and intake systems, respectively, of an internal combustion engine (not shown in FIG. 1) or the reverse. Valve head 20 is disposed adjacent to seat 14 for selectively mating therewith to open or to close communication between chambers 16 and 18. Valve stem, or pintle, 22 extends from head 20 through an axial bore 24 in body 12 and typically is actuated reciprocally by an external solenoid actuator (not shown) attached to pintle 22 to open and close the valve.

Figure 3:
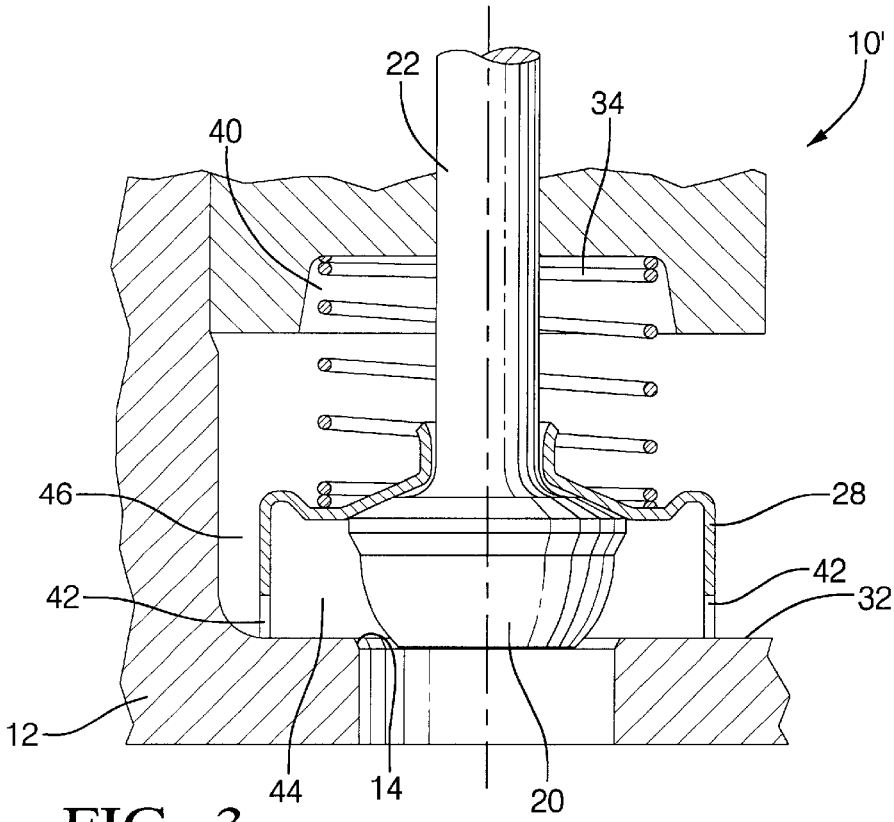
FIG. 3 is a view like that shown in FIG. 2, showing the valve partially open, with the flow restrictor still seated in the valve chamber.

Referring to FIGS. 2–6, a flow modifier 26 for a novel pintle valve 10' in accordance with the invention includes a flow restrictor 28, preferably cup-shaped, slidably disposed on pintle 22 through a close-fitting axial bore 30 in the restrictor, the cup being open towards and surrounding the valve head 20 and valve seat 14 to form a seal against the first internal valve wall 32 surrounding the seat, thus preventing flow therebetween when the valve is opened. The seal is maintained by a restrictor spring 34, preferably a coil spring surrounding the pintle, in compression between an outer surface 36 of the restrictor and a second internal wall 38 of the valve opposite wall 32. Preferably, wall 38 is provided with an annular well 40 for receiving spring 34. Restrictor 28 is provided with at least one passageway 42, and preferably a plurality of such passageways, communicating between the interior 44 and the exterior 46 of the restrictor, permitting fluid flow therethrough. Preferably, the total open cross-sectional area of passageways 42 is less than the total open area of seat 14 when head 20 is completely withdrawn, as shown in FIG. 3.

Preferably, restrictor 28 is provided with an annular neck 47 extending axially in a direction away from seat 14 to accommodate, preferably conformably, the upper side of valve head 20 when the valve is partially opened, as shown in FIG. 3, while the restrictor position remains unchanged. Restrictor 28 may be easily and inexpensively formed as by stamping and/or punching from sheet metal.

Figure 5:
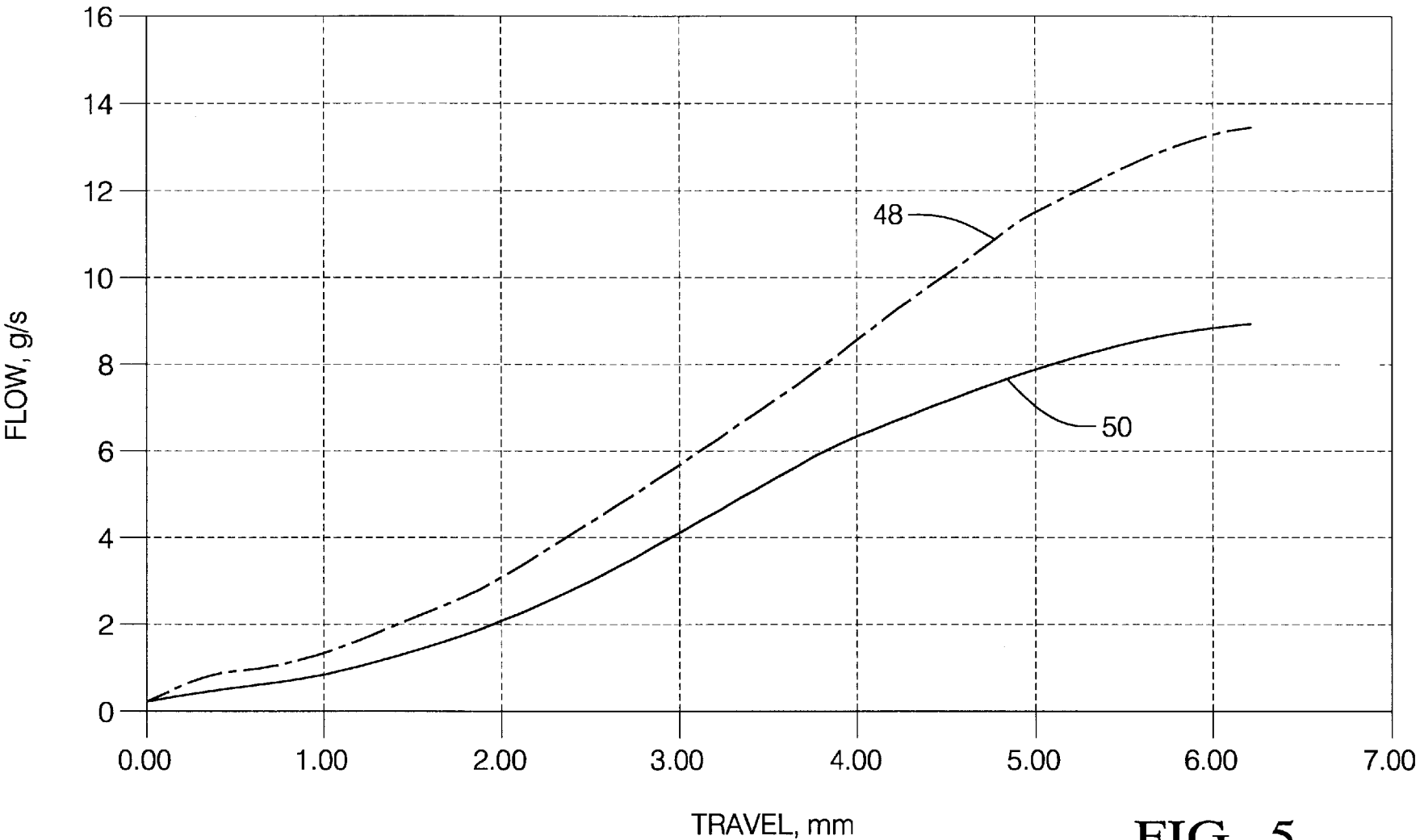
FIG. 5 is a graph showing flow delivery curves as a function of pintle travel for a typical pintle valve both without a flow restrictor and with a flow restrictor installed in accordance with the invention.

Flow through a valve is a function of the pressure drop across the valve and the restriction of the valve. In a prior art valve such as is shown in FIG. 1, the only significant flow restriction is the annulus between the valve seat and the valve head. The open area of this annulus changes more rapidly with pintle movement of the valve head for large valves than for smaller valves. In the prior art, the rate of change of restriction (control sensitivity) may be reduced by reducing the diameter of the valve seat and valve head, i.e., making a smaller valve. In accordance with the present invention, a larger valve is made to simulate a smaller valve by the insertion of additional restriction to flow, i.e., restrictor 28. The total pressure drop through the valve is unchanged, but the pressure drop is now divided between the variable restriction of the head/seat and the fixed restriction of restrictor 28. Since the action of the valve is unchanged but the pressure drop across the seat is reduced, the valve is effectively resized to have a different performance curve having increased relative control sensitivity (defined as the change in flow with unit change in pintle travel) and lower maximum flow. FIG. 5 shows curves of flow as a function of pintle travel for prior art valve 10 (curve 48) and for the same valve 10' equipped with a flow modifier 26 in accordance with the invention (curve 50).

Figure 4:
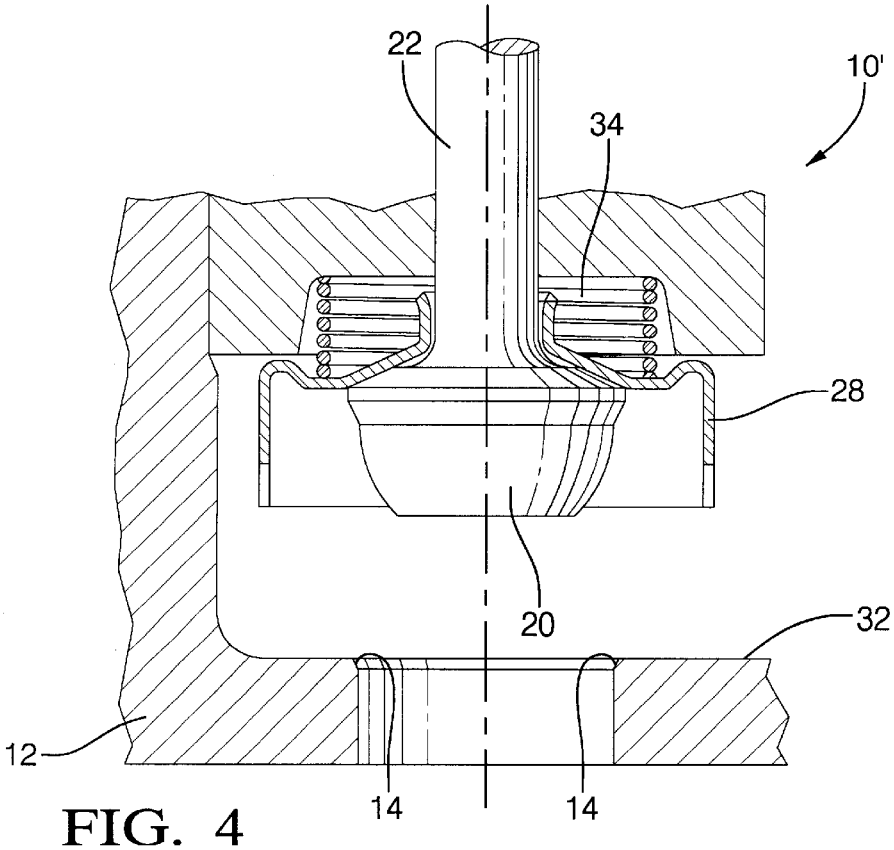
FIG. 4 is a view like that shown in FIGS. 2 and 3, showing the valve fully open, with the flow restrictor retracted.

In some instances, the upper requirement for flow may be greater than a restricted valve can provide. As shown in FIG. 4, valve head 20 can be withdrawn beyond the point shown in FIG. 3, engaging and carrying restrictor 28 with it and compressing spring 34 into well 40, whereby restrictor 28 is progressively brought out of sealing contact with wall 32. Performance of valve 10' then parallels the performance of prior art valve 10, restrictor 28 continues to impede flow to some extent, and thus the total possible flow through the restricted valve shown in FIG. 4 is still less than is possible through the prior art valve shown in FIG. 1.

Figure 6:
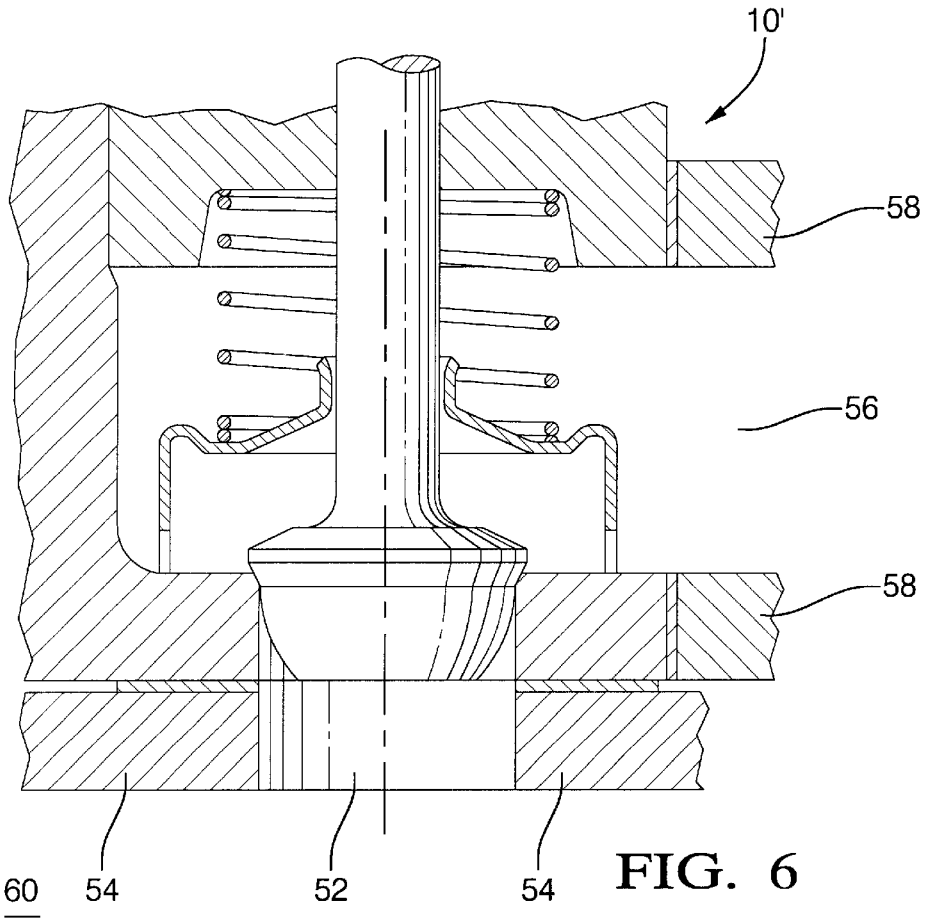
FIG. 6 is a cross-sectional view showing the embodiment of FIG. 2 installed for use between the intake and exhaust manifolds of an internal combustion engine.

The invention is especially useful in the field of automotive engines, in which it may be desirable to recirculate a portion of the exhaust gases into the intake manifold to reduce the burn temperature of the mix and thus reduce formation of nitrogen and sulfur oxides. The invention permits use of a single size of EGR valve on a wide range of engines, each usage being optimized by insertion of a flow modifier configured to serve a specific engine displacement range. FIG. 6 shows such a valve installed in an internal combustion engine 60 between port 52 in an exhaust manifold 54 and port 56 in an intake manifold 58 to permit exhaust gas recirculation therebetween.

Figure 7:
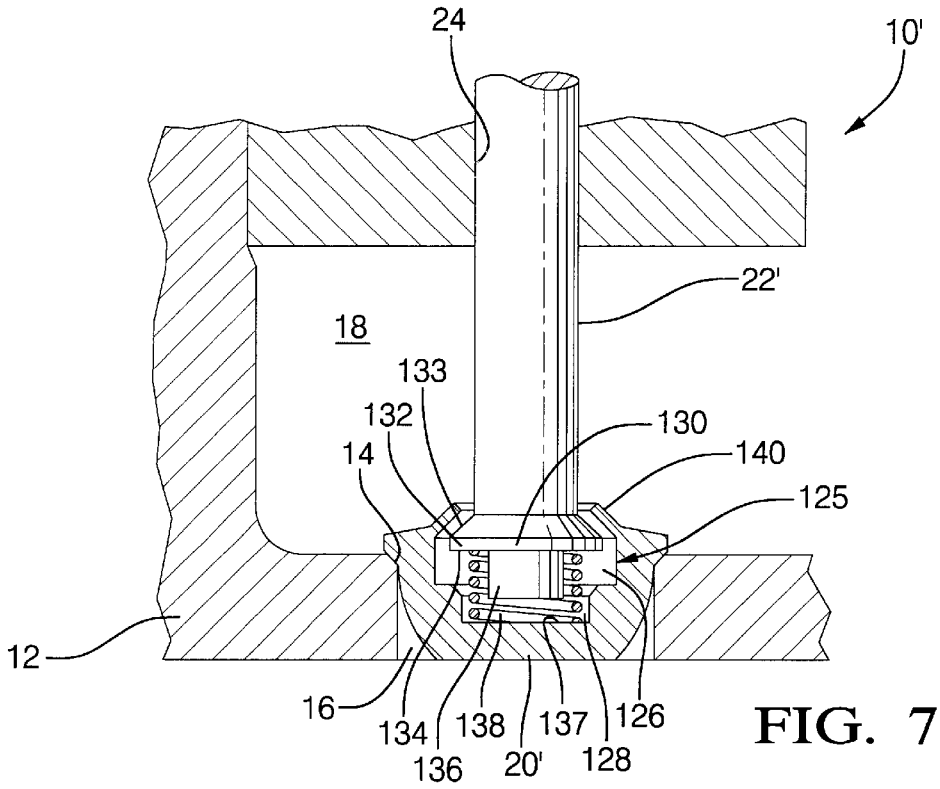
FIG. 7 is an elevational cross-sectional view of a second embodiment of a pintle valve in accordance with the invention, showing articulable attachment of the valve head to the valve pintle.

Referring to FIG. 7, another embodiment 10" of a pintle valve in accordance with the invention is substantially identical to the valve described in FIGS. 1–6 except for modification of head 20 and pintle 22 which are not integral but rather are individual components head 20' and pintle 22' which are combined with a spring 38 to form an articulable assembly. By "articulable" is meant having a flexible joint therein.

Head 20' is similar in shape to head 20 of valve 10' and performs the same function of axially interfacing with seat 14 to regulate the flow of fluid through valve 10".

Similarly, pintle 22' is similar in shape to pintle 22 and performs the same function of axially oscillating head 20' to interface with seat 14. However, head 20' is provided with an internal chamber 125 comprising an outer well 126 and an inner well 128 for receiving the end 130 of pintel 22'. End 130 includes a tapered flange 132 terminating in an axial face 134 and a reduced-diameter stub portion 136. Surface 133 of flange 132 opposite face 134 is preferably substantially frusto-conical. Coil spring 138 is disposed around portion 136 and is compressed between face 134 and bottom 137 of inner well 128. Outer well 126 is provided with a skirt 140 which is initially formed cylindrical to permit insertion of spring 138 and end 130 into head 20' and is then rolled inwards into axial interference with surface 133 during assembly to capture the pintle end 130 and spring 138 in head chamber 125.

As shown in FIG. 7, various geometric relationships among the pintle, spring, and head permit the head to be articulably self-aligning within the seat in accordance with the invention. First, with the valve fully closed, the axial length of stub portion 136 is insufficient for the stub to bottom out in inner well 128. Thus, axial force exerted on the head by the pintle is always transmitted through, and cushioned by, the spring (which must have a greater restorative force than any opening force which might be exerted against the head). Second, with the head engaged on the seat, pintle 22' is slightly overstroked axially such that flange 132 is disengaged from skirt 140. Thus, the only connection of the head to the pintle as the valve closes is resiliently through the spring. Third, the inner diameter of the spring is preferably greater than the outer diameter of the stub portion; the outer diameter of the spring is less than the inner diameter of the inner well; and the outer diameter of the flange is less than the inner diameter of the outer well, the combined relationships permitting the head to float axially and/or radially and/or rotationally about end 130 of the pintle as directed by engagement of head 20' with seat 14. When head 20' disengages from seat 14 as the valve is opened, the head is maintained in a generally coaxial relationship with pintle 22' as skirt 140 is engaged on surface 133 and the parallel ends of spring 138 keep face 134 and well bottom 137 substantially parallel.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. A flow modifier for a pintle valve to reduce the flow range and thereby increase the control sensitivity of the valve, the valve having a matable seat and head, comprising:

a) a flow restrictor sealingly disposable around said seat within said valve to add to the inherent flow restriction of said seat and head; and b) spring means disposed within said valve to urge said restrictor into sealing relationship with said valve.

2. A flow modifier in accordance with claim 1 wherein said restrictor is generally cup-shaped and is open in the direction of said valve seat.

3. A flow modifier in accordance with claim 2 wherein said valve further includes a pintle connected to said head and wherein said restrictor is slidably disposed on said pintle.

4. A flow modifier in accordance with claim 3 wherein said pintle is provided with a neck extending axially in a direction away from said valve seat to accommodate said valve head as said head is withdrawn from said seat.

5. A pintle valve, comprising:

a) a valve body having a chamber therein;

b) a first port in a first wall of said chamber, said first port including a valve seat;

c) a valve head disposed within said chamber for annular contact with said seat, said head being connected to a pintle for moving said head axially with respect to said seat, said pintle being disposed in a bore through a second wall of said chamber opposite said first wall; and d) a flow modifier including a flow restrictor sealingly disposable around said seat within said valve to add to the inherent flow restriction of said seat and head, and spring means disposed within said chamber to urge said restrictor into sealing relationship with said valve.

6. An internal combustion engine comprising:

a) an intake manifold having a first port therein;

b) an exhaust manifold having a second port therein; and c) an exhaust gas recirculation valve connected between said first and second ports, said valve having i) a valve body having a chamber therein, a first wall of said chamber including a valve seat, a valve head disposed within said chamber for annular contact with said seat, said head being connected to a pintle for moving said head axially with respect to said seat, and ii) a flow modifier including a flow restrictor sealingly disposable around said seat and said pintle within said chamber to add to the inherent fluid flow restriction of said seat and head, and spring means disposed within said chamber to urge said restrictor into sealing relationship with said valve.

* * * * *